US005709261A

United States Patent [19]

Streubel

[11] Patent Number: 5,709,261

[45] Date of Patent: Jan. 20, 1998

[54] BILLET GUIDING UNIT OF A CONTINUOUS CASTING PLANT FOR THIN SLABS

[75] Inventor: Hans Streubel, Erkrath, Germany

[73] Assignee: SMS Schloemann-Siemag Aktiengesellschaft, Düsseldorf, Germany

[21] Appl. No.: 621,778

[22] Filed: Mar. 22, 1996

[30] Foreign Application Priority Data

Mar. 25, 1995 [DE] Germany ..... 195 11 113.3

[51] Int. Cl.[6] ..... B22D 11/20

[52] U.S. Cl. ..... 164/454; 164/413; 164/442; 164/484

[58] Field of Search ..... 164/454, 484, 164/441, 442, 413

[56] References Cited

U.S. PATENT DOCUMENTS 4,567,933 2/1986 Lauener et al. ..... 164/442
5,348,074 9/1994 Streubel ..... 164/454

FOREIGN PATENT DOCUMENTS 2612094 10/1976 Germany .
4306853 9/1994 Germany .

*Primary Examiner*—Kuang Y. Lin
*Attorney, Agent, or Firm*—Friedrich Kueffner

[57] ABSTRACT

A billet guiding unit of a continuous casting plant for thin slabs includes guide rolls supported on oppositely located frames, wherein the frames are tensioned relative to each other against stop surfaces by means of tension rods. Hydraulic cylinders for extending or stretching the tension rods are mounted between corresponding stop surfaces of the frames. The distance between oppositely located rows of rolls of the frames are corrected by determining a lower deviation side of the slab by carrying out a continuous measurement of the thickness of the slab sides, by determining from the difference of the dimensions the required extension of the tension rods on the lower deviation side and by applying to the hydraulic cylinders the pressure required for the extension of the tension rods.

5 Claims, 3 Drawing Sheets

BILLET GUIDING UNIT OF A CONTINUOUS CASTING PLANT FOR THIN SLABS

BACKGROUND OF THE INVENTION

1. Field of the Invention

The present invention relates to a billet guiding unit of a continuous casting plant for thin slabs, wherein guide rolls are supported on oppositely located frames, wherein the frames are tensioned relative to each other against stop surfaces by means of tension rods.

2. Description of the Related Art

DE-A1 26 12 094 discloses a billet guiding unit in which the frame supporting the bearings of the guide rolls are connected by several tension rods, wherein the distance between the frame components is determined by an annular bracket mounted on each tension rod and by spacer members. For tensioning the frame, two sleeves supported against each other with inclined screw-shaped surfaces are rotated by a pressure medium cylinder. When the billet becomes jammed, the bushings are rotated in an unloading direction.

DE-A1 43 06 853 discloses a billet guiding unit of a continuous casting plant for continuous casting and rolling of thin slabs, wherein the frames of the billet guiding unit are connected by piston/cylinder units, and wherein an annular hydraulic cylinder and a spacer member each are arranged between stop surfaces of the upper and lower frames. By means of this unit, the guide rolls supported on the frames are adjusted into three defined positions during continuous casting.

The known billet guiding units described above are complicated and subject to malfunction.

SUMMARY OF THE INVENTION

In view of the above-described prior art, the present invention deals with the following problem: Aside from the state of alignment of the billet guide unit, the actual distance between the guide rolls of the above-described billet guiding unit which determines the cross section of the billet during the casting operation depends on the pretensioned condition of the tension rods and on the temperature. Consequently, the thin slabs emerging from the billet guiding unit may have wedge-shaped cross sectional shapes because the cross section of the billet is determined by the actual spacing between the rolls in the area of final solidification.

Therefore, it is the primary object of the present invention to provide a billet guiding unit with frames which are mechanically tensioned relative to each other by means of tension rods, in which it is possible during casting to compensate in a simple manner for an inaccurate alignment or unequal thermal expansion or wear of the guide rolls mounted on the frames which results in thickness variations over the cross section of the slab.

In accordance with the present invention, hydraulic cylinders for extending or stretching the tension rods are mounted between corresponding stop surfaces of the frames.

The configuration according to the present invention makes possible a compensation of thickness variations over the cross section of the slab with a simple, mechanically structured and, thus, operationally safe billet guiding unit. In this connection, the invention is based on the finding that the differences in dimension can be fully compensated by the achievable extension of the tension rods.

In accordance with another feature of the present invention, the annular hydraulic cylinders surround the tension rods between the stop surfaces of the frames.

The annular hydraulic cylinders are connected to a hydraulic pressure source through a valve which is supplied with a control signal from a control means including a slab thickness measuring device and a computer.

The distance between oppositely located rows of rolls of the frames are corrected by determining a lower deviation side of the slab by carrying out a continuous measurement of the thickness of the slab sides, by determining from the difference of the dimensions the required extension of the tension rods on the lower deviation side and by applying to the hydraulic cylinders the pressure required for the extension of the tension rods. As mentioned above, the slab may have a wedge-shaped cross-sectional shape; the lower deviation side is defined as the side having less than the desired thickness.

When the pressure is applied to the hydraulic cylinders, it is advantageous to take into consideration the state of pretensioning of the tension rods and/or the position of the pool tip within the billet guiding segment.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENT

Figure 1:
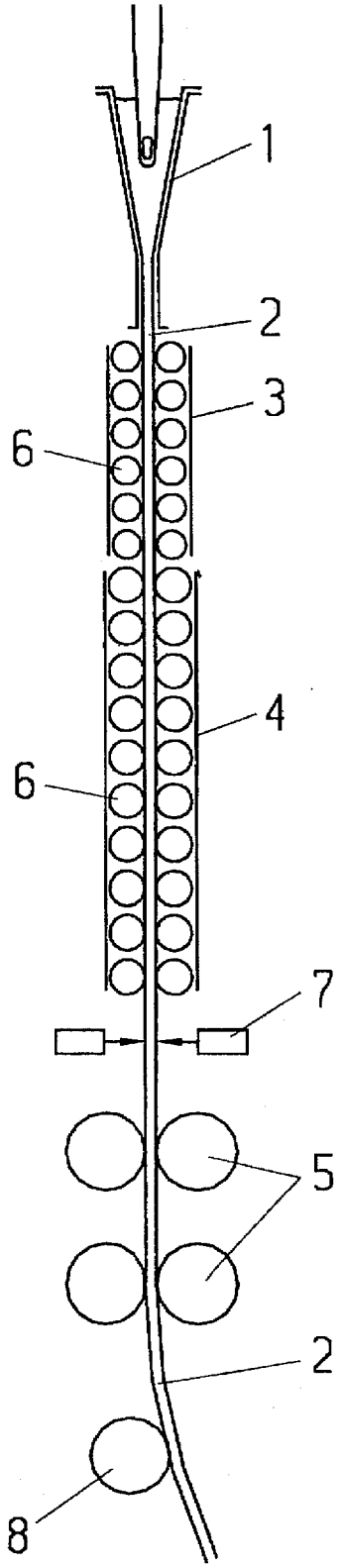
FIG. 1 is a schematic illustration of a continuous casting plant for thin slabs.

In the continuous casting plant schematically illustrated in FIG. 1 of the drawing, a continuous casting mold 1 for thin slabs 2 is followed by a billet guiding unit including a first section 3 and a second section 4. The cast slab 2 is conveyed by means of a driving unit 5 through the guiding unit 3, 4 formed by support guide rolls 6, wherein a liquid core of the billet is finally solidified as a result of cooling when emerging from the section 4. The thickness profile of the slab 2 is determined by measuring devices 7 underneath the guiding unit 3, 4. The slab 2 is then deflected by means of deflection roll 8.

Figure 2:
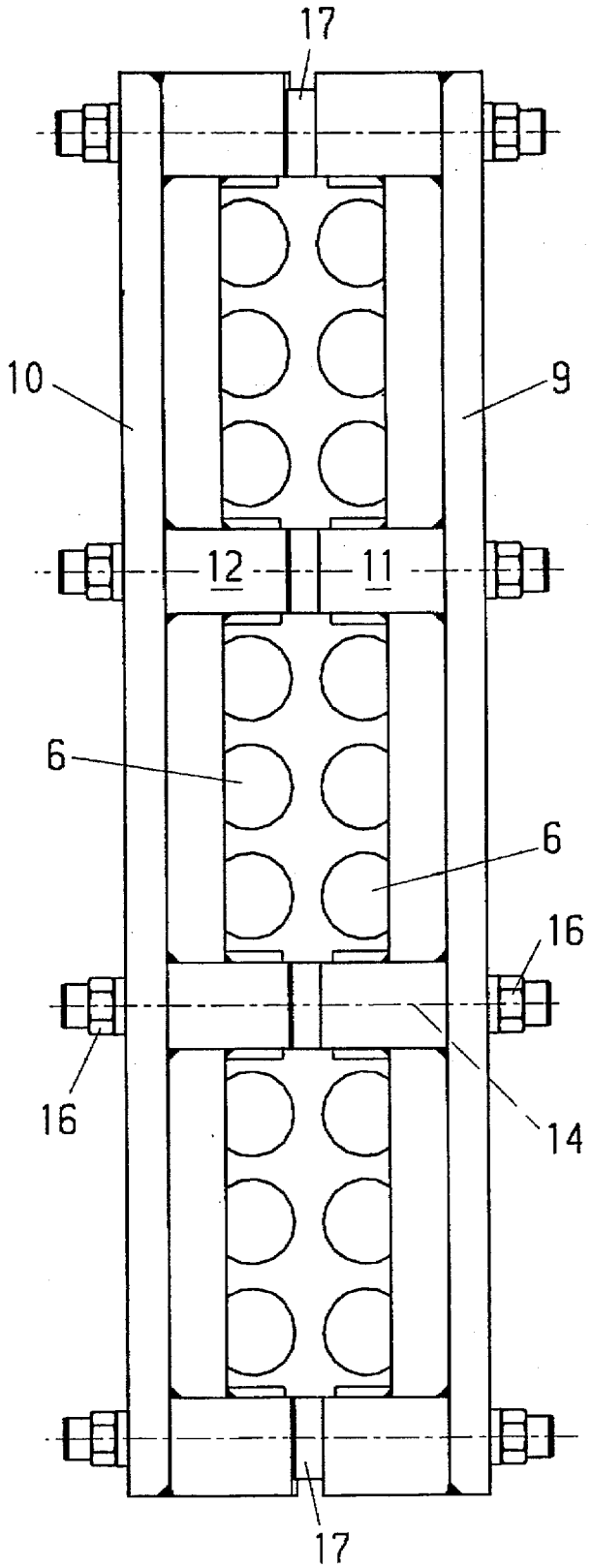
FIG. 2 is a side view, on a larger scale, of a portion of the billet guiding unit of the continuous casting plant.
Figure 3:
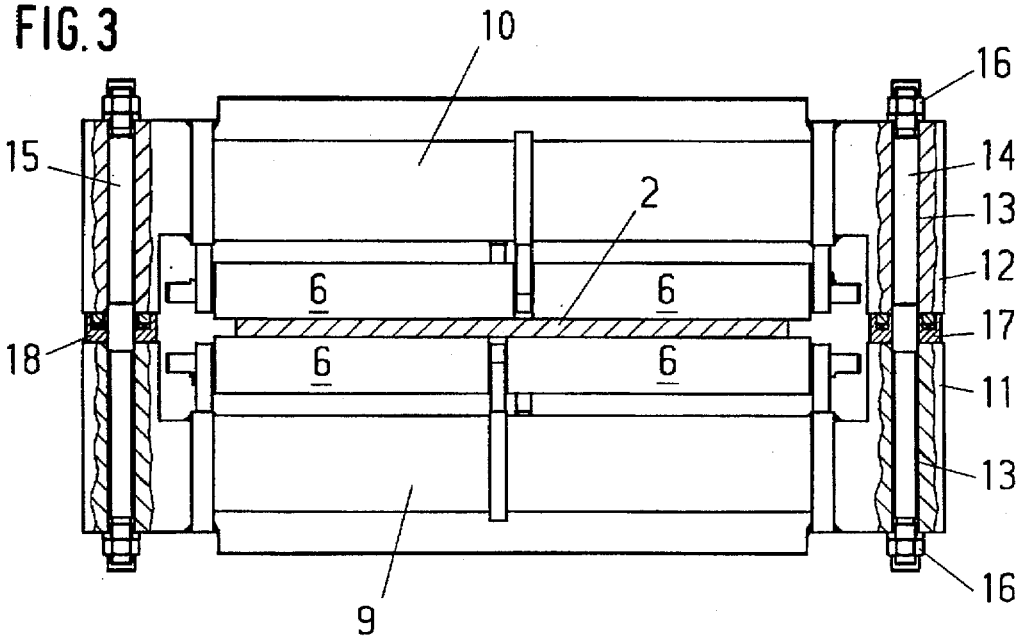
FIG. 3 is a top view, also on a larger scale and partially in section, of the billet guiding unit in billet travel direction.

As illustrated in FIGS. 2 and 3 of the drawing, the support guide rolls 6 of the second section 4 of the guiding unit are mounted on oppositely located frames 9, 10. The frames 9, 10 have on both sides thereof essentially cylindrical end pieces 11, 12 with openings 13 for tension rods 14, 15. At their ends projecting out of the frames 9, 10, the tension rods 14, 15 are provided with nuts 16 for adjusting the desired distance between the support guide rolls 6 and, thus, the thickness of the solidified slab 2.

Annular hydraulic cylinders 17, 18 surrounding the tension rods 14, 15 are arranged between corresponding end faces of the end pieces 11, 12. The frames 9, 10 are pretensioned through the tension rods 14, 15 and nuts 16 against the annular hydraulic cylinders 17, 18 with a force which is greater than the ferrostatic force acting on the guiding unit from the proportional section of the not fully solidified slab.

Figure 4:
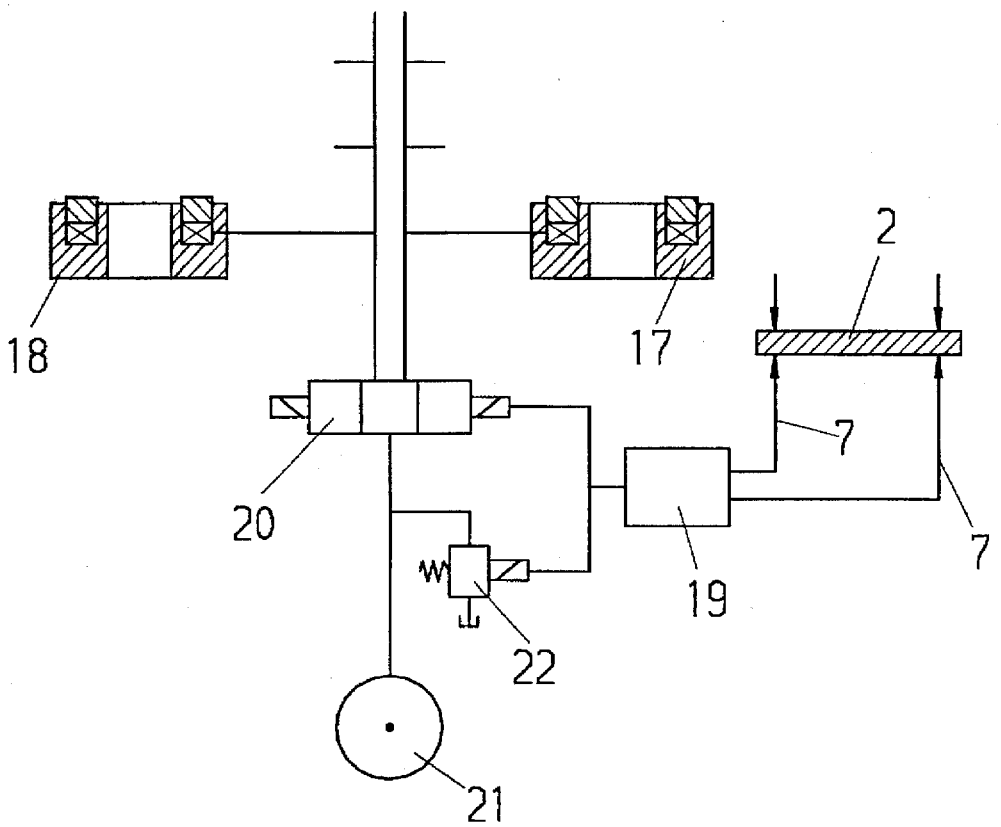
FIG. 4 is a schematic view showing the annular hydraulic cylinders and the control circuit for the annular hydraulic cylinders.

A control unit illustrated in FIG. 4 is provided for the annular hydraulic cylinders 17, 18. The components of the control unit are measuring devices 7, computer 19, hydraulic pressure source 21, pressure limiting valve 22 and multiple-way valve 20. From a difference of dimensions determined by the measuring devices 7, the computer forms signals for the pressure limiting valve 22 and the multiple-way valve 20 for applying pressure to the annular hydraulic cylinders 17 or 18 located at the lower deviation side of the slab 2 for obtaining a uniform cross sectional profile in accordance with the required extension of the tension rods 14 or 15 and for obtaining a uniform cross section of the slab.

The invention is not limited to the illustrated embodiment. In particular, for changing the size, exchangeable spacer members can be mounted between the frame surfaces, wherein conventional hydraulic cylinders are arranged outside of and separately from the tension rods 14, 15 between the frames 9, 10.

While specific embodiments of the invention have been shown and described in detail to illustrate the inventive principles, it will be understood that the invention may be embodied otherwise without departing from such principles.

I claim:

1. A billet guiding unit of a continuous casting plant for thin slabs, the guiding unit comprising oppositely located frames, guide rolls mounted on each frame, the frames having stop surfaces facing each other, tension rods extending through the frames and comprising means for tensioning the tension rods relative to the frames, and hydraulic cylinders mounted between the stop surfaces of the frames for extending the tension rods.

2. The guiding unit according to claim 1, wherein the hydraulic cylinders are annular hydraulic cylinders surrounding the tension rods.

3. The guiding unit according to claim 2, comprising a hydraulic pressure source connected to the annular hydraulic cylinders through a multiple-way valve, and control means for controlling the multiple-way valve, the control means comprising a slab thickness measuring device and a computer.

4. The guiding unit according to claim 1, wherein the hydraulic cylinders on one side of the guiding unit are annular hydraulic cylinders surrounding the tension rods.

5. A method of adjusting a distance between oppositely located frames of a billet guiding unit of a continuous casting plant for thin slabs, the guiding unit including oppositely located frames, guide rolls mounted on each frame, the frames having stop surfaces facing each other, tension rods extending through the frames and comprising means for tensioning the tension rods relative to the frames, and hydraulic cylinders mounted between the stop surfaces of the frames for extending the tension rods, the method comprising determining a lower deviation side of the slab by carrying out a continuous measurement of the thickness of the slab sides, determining from the dimensional difference a required extension of the tension rods on the lower deviation side, and applying a pressure to the hydraulic cylinders for effecting the required extension of the tension rods.

* * * * *